United States Patent [19]

Sapper

[11] 4,041,619

[45] Aug. 16, 1977

[54] SHOE

[76] Inventor: Peter Sapper, Auf der Burg, D-7121 Walheim, Wurttemberg, Germany

[21] Appl. No.: 656,635

[22] Filed: Feb. 9, 1976

[30] Foreign Application Priority Data

Mar. 21, 1975 Germany ..... 2512419

[51] Int. Cl.[2] ..... A43B 13/00

[52] U.S. Cl. ..... 36/25 R; 36/103

[58] Field of Search ..... 36/25 R, 32 R, 103, 36/104

[56] References Cited

U.S. PATENT DOCUMENTS 3,555,697 1/1971 Dassler ..... 36/104

3,936,956 2/1976 Famolare ..... 36/32 R

*Primary Examiner*—Patrick D. Lawson

[57] ABSTRACT

The specification describes a shoe, particularly of the moccasin type, having a sole body which is shaped, as viewed from above, substantially to conform to the shape of the foot so that it has a so-called "natural" shape. The sole of the shoe is lasted so that the upper surface has zero arching and located under the front portion and under the heel portion are downwardly extending projections, the two projections extending downwardly the same height from the upper surface so that, in use, the upper surface is parallel to the ground on which the shoe is placed.

9 Claims, 2 Drawing Figures

SHOE

The present invention relates to a shoe of the type worked over a last having a bottom the front portion of which, as viewed in plan, follows the contour of the foot and which thus possesses a broad front portion for upper and sole. This kind of shoe has in recent years become known by the description "natural shape". The orthopaedic advantage of this shape of shoe arises because of the broad front portion of the upper and accordingly also of the sole of the shoe, so that the big toe is no longer urged toward the other toes and thus the toes are not mutually "inhibited" as is the case with shoe upper shapes which end more or less pointedly at the front. In natural shape shoes the outer line of the front portion of the shoe which is situated inwardly i.e. along the big toe, does not greatly deviate from a straight line, in contrast to shoes having a more or less pointedly ending front portion of the upper.

The known natural shape shoes are worked over a last the bottom of which reproduces the contour of the foot in the front portion. Depending on the height of the heel of the known natural shape shoes, the last possesses a more or less pronounced "arching", i.e. curvature in its longitudinal direction. This arching or curvature is particularly pronounced in ladies' shoes having a higher heel. The result is that when such shoes are worn harmful effects (e.g. distortion of the spine) may occur in the posture of the user or already existing impairment of carriage is no longer counteracted. Thus, for the above mentioned reason, the known natural shape shoes do not adequately meet general medical, more particularly orthopaedic, requirements.

Additionally, in these shoes, where they have the possibility of free or optimum mobility, the toes are scarcely induced to perform any gripping movement and thus the foot muscles are hardly strengthened and the blood circulation in the foot is not much stimulated either.

In order to compensate for the disadvantage connected with the arching of the last or the height of the heel it would have seemed obvious to design the natural shape shoe to be heel-less. But this would excessively alter or impair the fashionable appearance of the shoe. This applies to a shoe developed in Denmark the special feature of which consists in that the heel part lies considerably lower than the toes. This shoe is meant to move the centre of gravity of the body toward the rear, so as to counteract posture defects. The use of this shoe necessarily leads to a quite different mode of walking and bodily carriage, i.e. because it is necessary to avoid tipping backward. The changed walk and the altered attitude when standing must be accepted with these shoes.

Accordingly there is provided a shoe comprising an upper and a sole, the sole including a sole body having upper and lower surfaces, the shape of the sole body, as viewed from above, being approximately that of the foot of a wearer, a front portion, an arch portion and a heel portion of the sole and two downwardly extending projections extending across the width of the lower surface of said sole body, the projections being produced by a variation in the thickness of the sole body, the first of said projections being located under the heel portion of the sole body adjacent the arch portion and the second of said projections being located under the front portion at the location of the ball of the foot of the wearer, the projections being of substantially equal height from said upper surface, the upper surface of the sole body in the arch and heel portion being curveless in the longitudinal direction and having a longitudinal axis in these portions extending in a horizontal plane.

As a result of the "zero arching" of the last employed in the production of the shoe according to the invention the moulded sole has no curvature at its upper side (foot side) in the arch and heel portion as viewed in longitudinal direction and neither has the last. The same, of course, also applies to a special insole when such has been fitted into the shoe, but in genuine moccasins this is known to be absent because of the special way of producing moccasin uppers. This feature of the invention can also be defined in that a last is employed for producing the shoe according to the invention the bottom of which last has a longitudinal axis lying on a straight line in the ankle and heel portion. The same then also applies for the top side of the outsole and an optionally present insole. Of course, this does not alter the fact that, as viewed from the end of the shoe, both the last and the soles can have the customary curvature. The design of the outsole according to the invention, or more precisely of the running side thereof, thus results from suitable differences in the thickness of the outsole over the length thereof. As a result of the zero arching of the last and of its longitudinal axis extending within the horizontal plane in the arch and heel portion, when a person stands upright in the shoes according to the invention the foot is no longer forced at a more or less acute angle to the ground, as is the case with the known shoes having heels. In the shoe according to the invention the user thus stands perpendicularly to the ground, notwithstanding a heel. In this way harm to the bodily carriage may be prevented or it is possible to counteract such harm. Moreover, standing at a right angle to the ground leads to relaxing and to a natural equilibrium.

The downwardly extending projections provided at the underside of the shoe according to the invention result in positive support of the foot in the region of the metatarsal bones and in activation of the gripping movements which nature has intended for the toes, which ultimately leads to natural rolling-off of the foot, just as it is the general purpose of the invention to provide the precondition for rolling off of the shod foot to come as near as possible to barefoot running. The projection in the area of the front part of the sole effectively represents a substitute for the toe bulge as is known from exercise sandals having wooden platforms. It is true that the outsole of the platform is of flat, i.e. heel-less design and the toe bulge is fashioned at the upper side (foot side) of the platform. The concept of these sandals in which the toes have free play for their movement largely meets orthopaedic demands. But this concept cannot readily be transferred to normal walking footwear which, in contrast to the exercise sandals, has a closed upper and therefore may be worn in any kind of weather. The invention, of course, can also be applied to sandals or other open shoes.

The projections are preferably of rounded configuration whereby rolling-off of the sole on the ground is facilitated.

As already mentioned, the outsole of the invention represents that shaped part which may be made of rubber or of plastics material by pressure casting or moulding methods. Merely by way of example, suitable materials are latex, PVC or polyurethane foam. The sole may also be of laminated construction in order to make allowance for the greater wear of the running side.

Irrespective of its novel design the sole according to the invention is subdivided in customary manner into a front portion which is achieved by the special configuration of its lower surface, an arch portion and a heel portion. As is known from known footwear the arch portion may also be reinforced in the shoe according to the invention by an insert for example of steel.

In order that the invention may more readily be understood, the following description is given, merely by way of example, reference being made to the accompanying drawings, in which.

Figure 1:
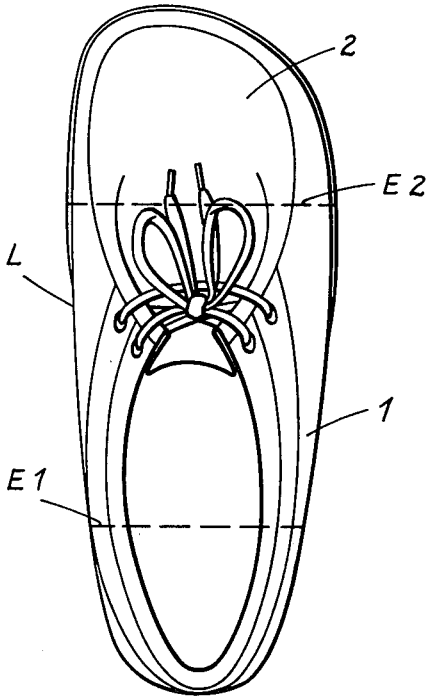
FIG. 1 is a plan view of one embodiment of shoe according to the invention.

From FIG. 1 it is apparent that the shoe generally designated by the numeral 1, which is made as a moccasin and consequently has the usual moccasin apron 2 in the front portion of the upper, possesses a so-called natural shape. Thus the shoe is comparatively broad in its front portion and thus shaped to fit the foot so that the toes have freedom of movement. The outline of the inner side (big toe side) of the shoe which is typical of the natural shape is also discernable. At this side the contour of the shoe proceeds in a substantially straight line L in the front part.

The two broken lines E1 and E2 shown in FIG. 1 indicate the positions of the two downwardly extending projections E1 and E2 at the underside of the outsole.

Figure 2:
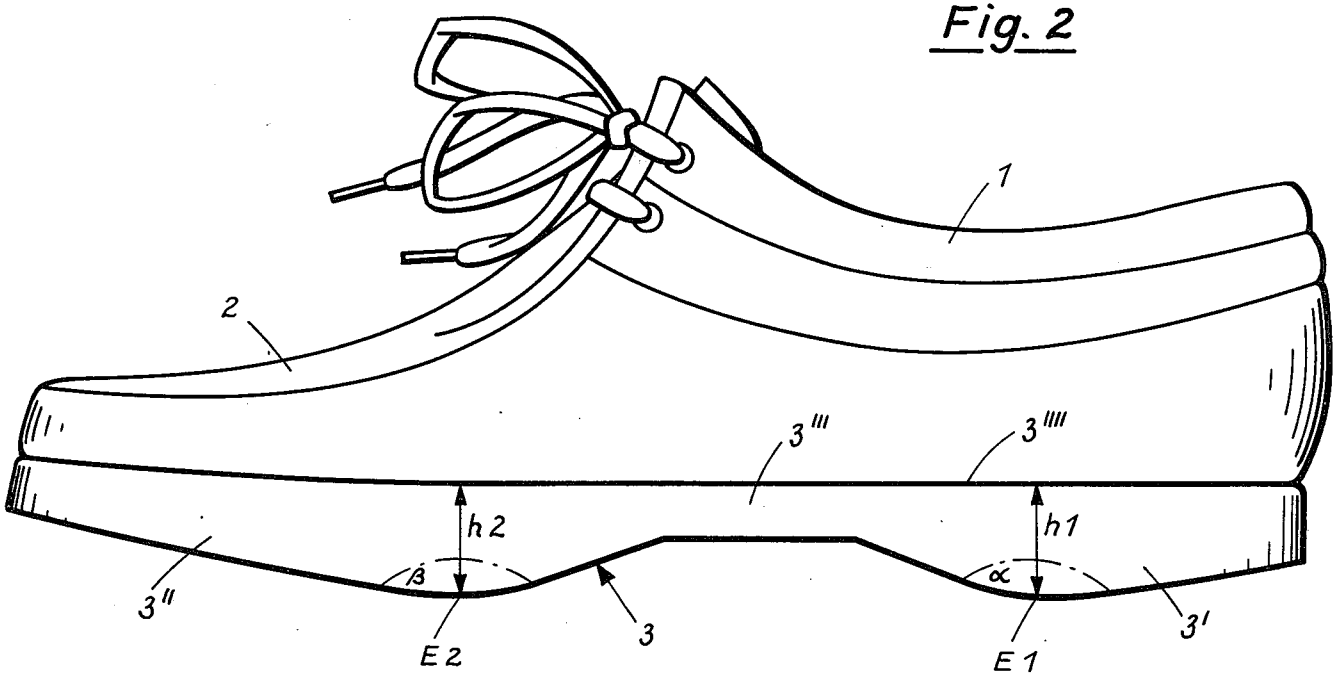
FIG. 2 is a side view of the shoe on a larger scale than in FIG. 1.

The design of the sole 3 according to the invention can be seen in detail in FIG. 2. One of the projections E1, lies in the region of the heel 3′ which is proximate the arch and the other projection lies in the region of the ball of the foot of the outsole front portion 3″. The height h1 of the projection E1 equals the height h2 of the projection E2. This means that in the areas of the two projections the outsole is of similar thickness. The angles $\alpha$ and $\beta$ subtended by the projections E1 and E2 are suitably of between 150 and 160°, the heel and front portions of the outsole next to the respective projection falling away more steeply toward the arch portion 3‴ than toward the heel seat or the toe of the shoe. In the illustrated embodiment, the underside of the heel and of the outsole front portion are rounded in the regions of the projections E1 and E2, i.e. they are of dome-shaped configuration.

FIG. 2 further shows that the shoe has been worked over a last with zero arching so that the upper side 3⁗ of the outsole 3 has a longitudinal axis lying on a straight line. The foot thus obtains in the shoe an exactly horizontal position so that a right angle is formed between the foot and the lower leg, whereby the same, natural, conditions are provided as for an unshod foot.

The outsole 3 may be designed, in known manner, as a moulded sole.

It is apparent from the drawing that the underside of heel and outsole front portion fall away in a continuous line to either side of the dome-shaped projections. In this manner a "flowing" rolling-off of the foot, similar to barefoot running, is made possible. This effect cannot be obtained with a shoe having a cross-bar provided at the underside of the outsole front portion. In contrast thereto, the advantage of the shoe according to the invention resides in the fact that the raised portions E1 and E2 in co-operation with the surfaces adjoining thereat act in the manner of rollers.

I claim:

1. A shoe comprising an upper and a sole, the sole including a sole body having upper and lower surfaces, the shape of the sole body, as viewed from above, being approximately that of the foot of a wearer, a front portion, an arch portion and a heel portion of the sole, two downwardly extending projections extending across the width of the lower surface of said sole body, the projections being produced by variations in the thickness of the sole body, the first of said projections being located under the heel portion of the sole body adjacent the arch portion and the second of said projections being located under the front portion at the location of the ball of the foot of the wearer, the projections being of substantially equal height from said upper surface, the upper surface of the sole body in the arch and heel portions being curveless in the longitudinal direction and having a longitudinal axis in said portions extending in a horizontal plane.

2. A shoe according to claim 1, wherein the projections are of curved dome-shaped configuration.

3. A shoe according to claim 2, wherein the angle subtended by said curved portions of said projections is between 150° and 160°.

4. A shoe according to claim 1, wherein the underside of the heel and the outsole front portion blend in a continuous line on either side of said projections.

5. A shoe according to claim 1, wherein the sides of the projections facing towards one another and towards the arch portion extend at a steeper angle to the upper surface than the sides which face away from one another towards the front part and heel part of the shoe.

6. A shoe according to claim 1, wherein the sole and heel portions of the upper are moulded onto the sole.

7. A shoe sole comprising a sole body having upper and lower surfaces, the shape of the sole body, as viewed from above, being approximately that of the foot of a wearer, a front portion, an ankle portion and a heel portion of the sole, two downwardly extending projections extending across the width of the lower surface of said sole body, the projections being produced by variations in the thickness of the sole body, the first of said projections being located under the heel portion of the sole body adjacent the ankle portion and the second of said projections being located under the front portion at the location of the ball of the foot of the wearer, the projections being of substantially equal height from said upper surface, the upper surface of the sole body in the ankle and heel portions being curveless in the longitudinal direction and having a longitudinal axis in said portions extending in a horizontal plane.

8. A shoe sole according to claim 7 wherein the lower surface of the sole body from the projection located under the heel extends in a substantially continuous line to the back of the heel portion, reducing the thickness thereof at the back of the heel, and the lower surface of the sole body from the projection located under the ball of the foot extends in a substantially continuous line to the toe of the sole reducing the thickness thereof at the toe end, and there is formed between the two projections an arch portion wherein the thickness of the sole is reduced along the entire extent thereof, giving the sole the appearance of having a heel.

9. A shoe according to claim 1, wherein the lower surface of the sole body from the projection located under the heel extends in a substantially continuous line to the back of the heel portion, reducing the thickness thereof at the back of the heel, and the lower surface of the sole body from the projection located under the ball of the foot extends in a substantially continuous line to the toe of the sole reducing the thickness thereof at the toe end, and there is formed between the two projections an arch portion wherein the thickness of the sole is reduced along the entire extent thereof, giving the sole the appearance of having a heel.

* * * * *